US009016015B2

(12) United States Patent
Neuhofer, Jr.

(10) Patent No.: US 9,016,015 B2
(45) Date of Patent: Apr. 28, 2015

(54) DEVICE FOR BRIDGING THE GAP BETWEEN A WALL AND A FLOOR COVERING

(71) Applicant: Franz Neuhofer, Jr., Zell am Moos (AT)

(72) Inventor: Franz Neuhofer, Jr., Zell am Moos (AT)

( * ) Notice: Subject to any disclaimer, the term of this patent is extended or adjusted under 35 U.S.C. 154(b) by 0 days.

(21) Appl. No.: 14/343,059

(22) PCT Filed: Jan. 8, 2013

(86) PCT No.: PCT/AT2013/050005
§ 371 (c)(1),
(2) Date: Mar. 6, 2014

(87) PCT Pub. No.: WO2013/104009
PCT Pub. Date: Jul. 18, 2013

(65) Prior Publication Data

US 2014/0215940 A1 Aug. 7, 2014

(30) Foreign Application Priority Data

Jan. 9, 2012 (AT) ..... A 50001/2012

(51) Int. Cl.
*E04F 19/04* (2006.01)
*E04F 19/06* (2006.01)

(52) U.S. Cl.
CPC ..... *E04F 19/04* (2013.01); *E04F 19/065* (2013.01); *E04F 19/066* (2013.01); *E04F 19/0477* (2013.01)

(58) Field of Classification Search
CPC ..... E04F 19/02; E04F 19/04; E04F 19/061; E04F 19/064; E04F 19/066; E04F 19/0463; E04F 2019/0454; E04F 19/065; E04F 19/0477; Y10T 16/131; Y10T 403/7096
USPC ..... 52/287.1, 396.04, 396.1, 459–461, 177, 52/211, 393–395, 402, 464, 466, 468, 52/716.1, 718.01, 718, 2, 718.04
See application file for complete search history.

(56) References Cited

U.S. PATENT DOCUMENTS 3,273,295 A * 9/1966 Amirikian ..... 52/223.8
6,287,046 B1 * 9/2001 Neuhofer, Jr. ..... 403/382

(Continued)

FOREIGN PATENT DOCUMENTS

DE 20 2006 019 445 U1 4/2007
EP 2 369 095 A1 9/2011

(Continued)

OTHER PUBLICATIONS

International Search Report of PCT/AT2013/050005, mailed Apr. 25, 2013.

*Primary Examiner* — Jeanette E Chapman
(74) *Attorney, Agent, or Firm* — Collard & Roe, P.C.

(57) ABSTRACT

A device is described for bridging the gap (4) between a wall (2) and a floor covering (3) having a floor profile (5), which is supported in one longitudinal edge region on the floor covering (3) and in the opposing longitudinal edge region on a wall-side spacer profile (6), which rests on a subfloor (1) for the floor covering (3). To achieve simple adaptation to different support heights, it is proposed that the spacer profile (6) have at least two contact areas, which are arranged angularly offset to one another about the profile longitudinal axis, and these contact areas have opposing supports for the floor profile (5), wherein the support lengths determined by the spacing of the supports from the associated contact areas are different.

7 Claims, 2 Drawing Sheets

(56) References Cited

U.S. PATENT DOCUMENTS

| | | | | |
|---|---|---|---|---|
| 6,647,680 | B2 * | 11/2003 | Daly et al. | 52/287.1 |
| 8,099,921 | B2 | 1/2012 | Muehlebach | |
| 8,171,698 | B2 * | 5/2012 | Neuhofer jun. | 52/718.06 |
| 8,572,912 | B2 * | 11/2013 | Neuhofer, Jr. | 52/211 |
| 2005/0229517 | A1 | 10/2005 | Gomez | |

FOREIGN PATENT DOCUMENTS

| | | | |
|---|---|---|---|
| FR | 2 873 140 | A1 | 1/2006 |
| FR | 2957374 | A1 * | 9/2011 |
| WO | 2006/093866 | A2 | 9/2006 |
| WO | 2008/092561 | A1 | 8/2008 |

* cited by examiner

DEVICE FOR BRIDGING THE GAP BETWEEN A WALL AND A FLOOR COVERING

CROSS REFERENCE TO RELATED APPLICATIONS

This application is the National Stage of PCT/AT2013/050005 filed on Jan. 8, 2013, which claims priority under 35 U.S.C. §119 of Austrian Application No. A50001/2012 filed on Jan. 9, 2012, the disclosure of which is incorporated by reference. The international application under POT article 21(2) was not published in English.

FIELD OF INVENTION

The invention relates to a device for bridging the gap between a wall and a floor covering having a floor profile, which is supported in a longitudinal edge region on the floor covering and in the opposing longitudinal edge region on a wall-side spacer profile, which rests on a subfloor for the floor covering.

DESCRIPTION OF THE PRIOR ART

To bridge the gaps between a floor covering and a wall, using a floor profile is known (EP 2 369 095 A1), which is supported on one side on the floor covering and on the other side on a spacer, which is composed of profile parts arranged along the wall having mutual spacing, which rest on the subfloor for the floor covering and which form a receptacle groove open on top for a strip of an adhesive tape connected to the floor profile, for example. Notwithstanding the fact that the profile parts can only result in a load-bearing, secure support for the floor profile if the profile parts can sufficiently support themselves on the wall, a corresponding shortening of the support leg of the profile parts resting on the subfloor is required for the adaptation of the spacer to different thicknesses of the floor covering, which can only be carried out comparatively simply if the support leg is provided with intended detachment points for this purpose, which in turn impair the carrying capacity of the profile parts.

SUMMARY OF THE INVENTION

The invention is therefore based on the object of designing a device of the type described at the beginning such that an adaptation to floor coverings of different thicknesses is possible in a simple manner, without having to shorten the spacer profile in an additional work step.

The invention achieves the stated object in that the spacer profile has at least two contact areas, which are angularly offset to one another about the profile longitudinal axis, and these contact areas have opposing supports for the floor profile, wherein the support lengths determined by the spacing of the supports from the associated contact areas are different.

By way of the use of such a spacer profile having contact areas which are angularly offset to one another, it is possible to use the spacer profile in various rotational locations about the profile longitudinal axis such that the spacer profile respectively rests with one contact area on the subfloor and the support for the floor profile, which is opposite to this support area, is used, which allows a simple adaptation of such spacers to different thicknesses of the floor covering by way of the support lengths determined by the distance of the support from the associated contact area, and allows this with good stability for the spacer profile, because the spacer profile can rest flatly on the subfloor via the contact areas. The spacer profile can be used in the form of a profile rail or of profile parts, which break up the rail and are arranged with spacing from one another.

Since in general three thickness ranges for floor coverings can be expected, the spacer profile can have three contact areas, which are perpendicular to one another, having the associated supports for different support lengths. In this case, the spacer profile only has to be pivoted by 90° about the profile longitudinal axis in each case, to be able to use the spacer profile for different support lengths. Such an implementation of the spacer profile allows the implementation of the spacer profile having a substantially rectangular profile cross section and a support which is lengthened beyond a wide side of the rectangle cross section, to be able to use the opposing long sides and wide sides respectively as contact area and support. The support which is lengthened beyond a wide side has a support length, in cooperation with the opposing long side of the profile cross section, which is between the support lengths formed by the wide sides, on the one hand, and by the long sides, on the other hand.

Floor profiles, which are used not only to bridge a gap between floor covering and wall, frequently have an attachment on the underside for the pivotably-adjustable accommodation of the head of a fastening anchor, to use these floor profiles in various pivot positions as transition, terminus, or expansion joint profiles and to be able to connect them via fastening anchors to the subfloor. In the case of such floor profiles, the risk exists under some circumstances that the receptacle attachments for the fastening anchors will extend in the region of the support protruding beyond the wide side. To counter this risk and also to provide spacers suitable for such floor profiles having a receptacle attachment for fastening anchors, the support of the spacer profile protruding beyond the wide side can be arranged offset in the direction of the adjoining long side of the rectangular profile cross section, so that space is provided for a receptacle attachment on the underside of the floor profile.

The spacer profile can be implemented as a solid profile. However, particularly simple design conditions result if the spacer profile is implemented as a hollow profile, the legs of which result in the contact areas. Such a hollow profile can be implemented as open around the circumference. Better stability conditions result, however, if the spacer profile is implemented as a hollow profile closed around the circumference.

Because of the stable contact of the spacer profile on the subfloor, no fastening of the floor profile on the spacer profile is required per se, in particular not if the floor profile is connected via fastening anchors to the subfloor. However, if a corresponding connection is to be produced between the spacer profile and the floor profile, this can advantageously be achieved in that the floor profile is fastened via adhesive beads on the floor covering and on the spacer profile.

BRIEF DESCRIPTION OF THE DRAWING

The object of the invention is shown as an example in the drawing. In the figures.

DESCRIPTION OF THE PREFERRED EMBODIMENT

Figure 1:
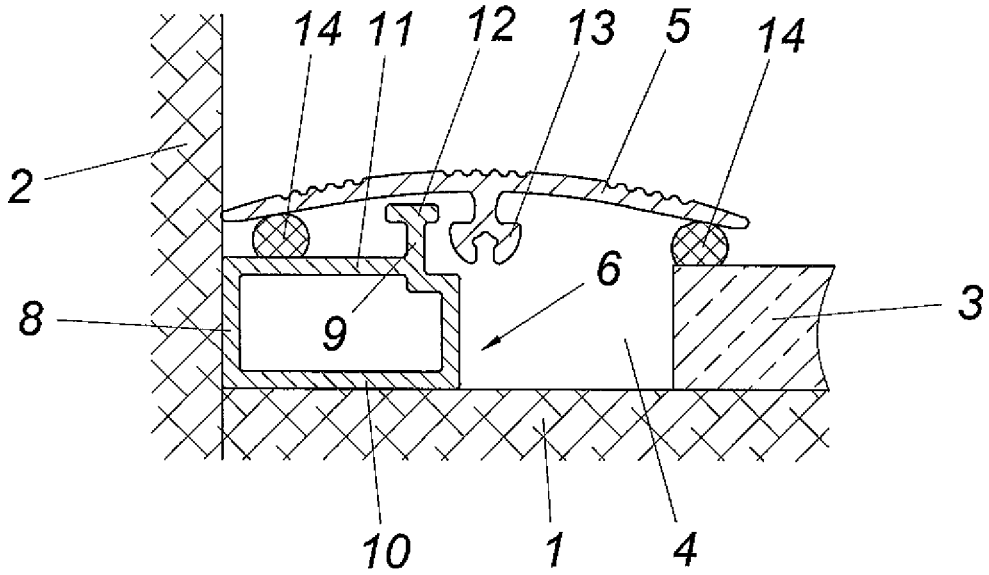
FIGS. 1 to 3 show a device according to the invention for bridging a gap between a wall and a floor covering in a simplified cross section in three different usage locations of the spacer profile.
Figure 2:
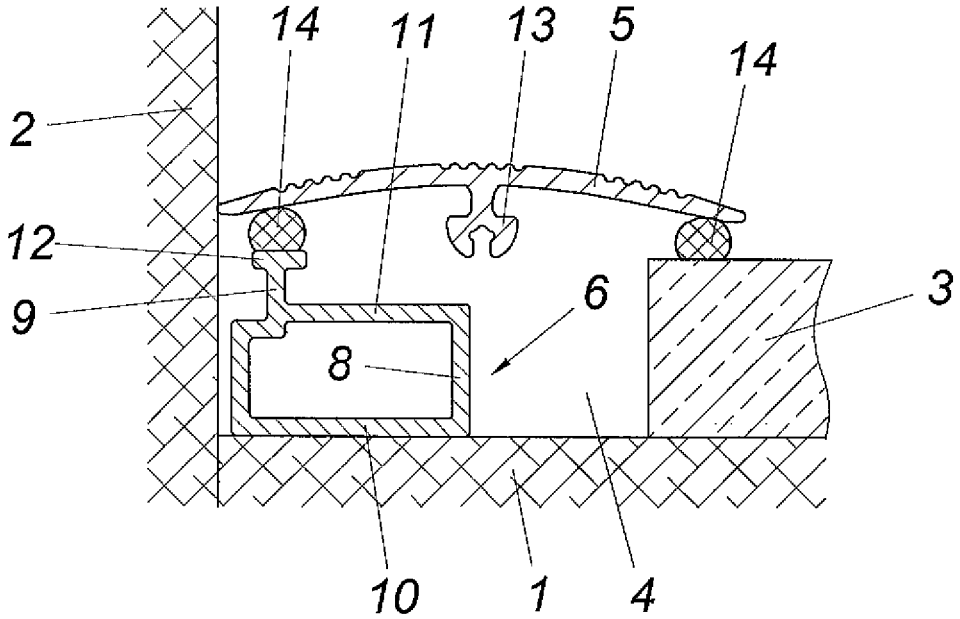
Figure 3:
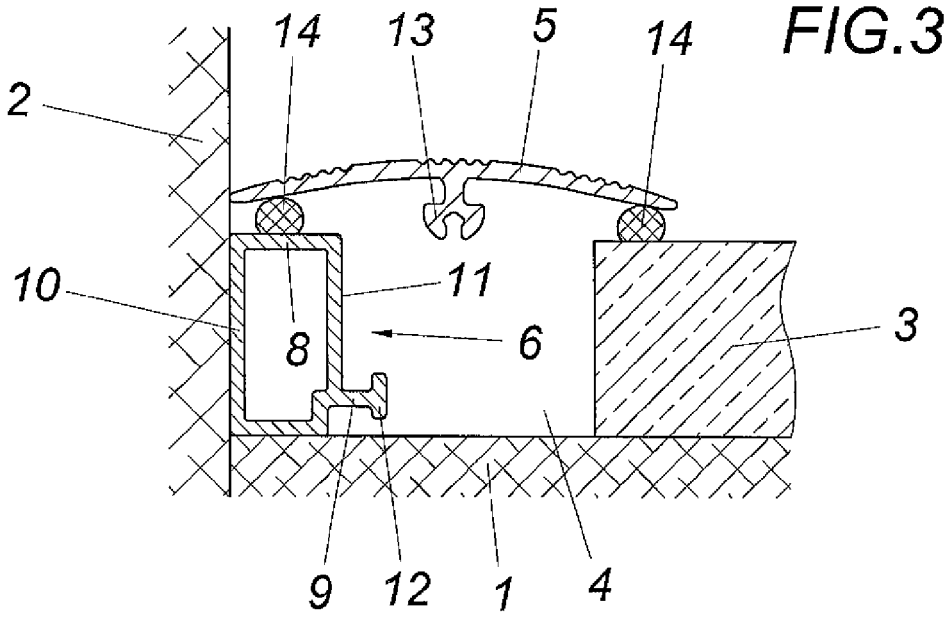

FIGS. 1 to 3 show a wall 2, which protrudes from a subfloor 1, and a floor covering 3, which is applied to the subfloor 1, between which and the wall 2, a gap 4 is provided. This gap 4 is to be bridged with the aid of a floor profile 5, which is supported in one longitudinal edge region on the floor covering 3 and in the opposing wall-side longitudinal edge region on a spacer profile 6 arranged in the wall region. The spacer profile 6 has, according to the exemplary embodiment, a substantially rectangular hollow profile 7 having three legs 8, 9, 10 perpendicular to one another, which cause a differing support length, so that the spacer profile 6 can be used in different rotational positions about the profile longitudinal axis for different support lengths. The arrangement is made such that upon use of the spacer profile 6 in the rotational position shown in FIG. 1, in which the support length of the leg 8 is used, the long side 11 of the rectangular hollow profile 7, beyond which the leg 9 protrudes, is used as the support for the floor profile 5. In FIG. 2, the greater support length of the leg 9 in relation to the leg 8 is used for adaptation to a greater thickness of the floor covering 3 for the floor profile support. The leg 9 is provided for this purpose with a support 12 for the floor profile 5. Finally, FIG. 3 shows the rotational position of the spacer profile 6 for the longest support length by the leg 10, wherein the leg 8 can be used as a support for the floor profile 5. In all three usage cases, the spacer profile 6 rests via one long side or one wide side of the rectangular hollow profile 7 as a contact area on the subfloor 1, which ensures stable support of the spacer profile 6. The spacer profile 6 can comprise individual profile parts arranged with mutual spacing along the wall 2 or can be formed by a continuous profile rail.

As may be inferred from the illustration according to FIG. 1, the floor profiles 5 can have a receptacle attachment 13 for a fastening anchor on the underside, which results in space difficulties under some circumstances, if the leg 9 of the spacer profile 6 is arranged in extension of the wide side of the rectangular hollow profile 7. For this reason, the leg 9 of the spacer profile 6 having the support 12 is arranged offset in relation to the wide side of the rectangular hollow profile 7 in the direction of the long side 11, so that if needed the receptacle attachment 13 of the floor profile 5 comes to rest laterally adjacent to the leg 9.

Figure 4:
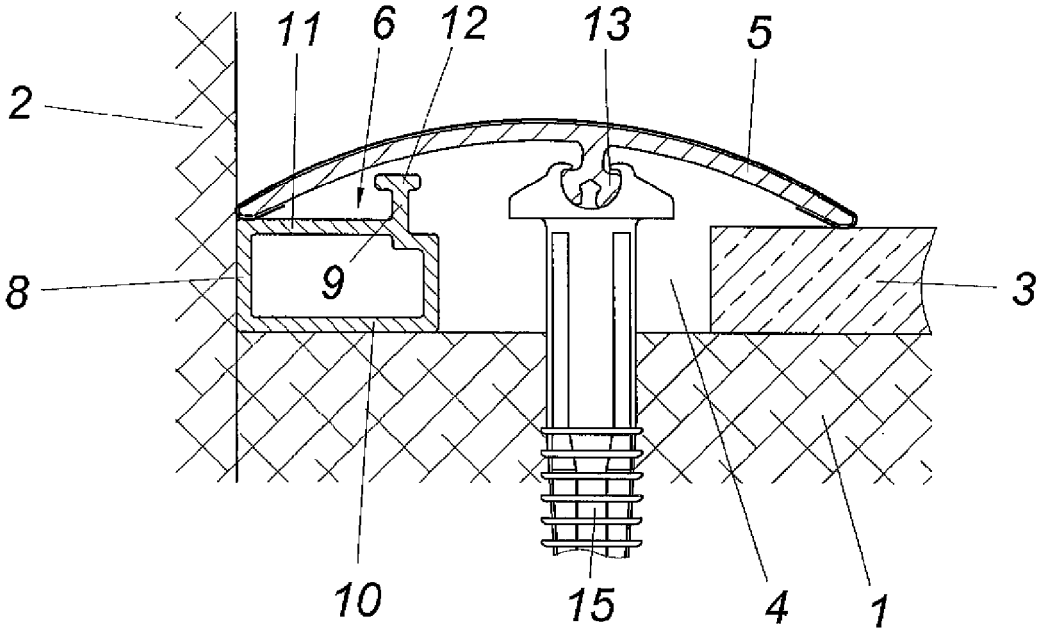
FIG. 4 shows an illustration corresponding to FIG. 1 of an embodiment variant of a device according to the invention.

To connect the floor profiles 5 to the floor covering 3 and the spacer profile 6, the floor profiles 5 can be provided with adhesive beads 14 extending along their longitudinal edges on the underside, which is not required, however. In FIG. 4, a separate fastening of the floor profile 5 on the subfloor 1 is provided, specifically with the aid of a fastening anchor 15, whose head 16 is connected in a formfitting manner to the receptacle attachment 13 of the floor profile 5. In such a case, the necessity is omitted of connecting the floor profile 5 to the spacer profile 6, although such a connection is not precluded, because the possibility also exists of connecting the spacer profile 6 to the subfloor 1 or the wall 2.

The invention claimed is:

1. A device for bridging the gap between a wall and a floor covering having a floor profile, which is supported in one longitudinal edge region on the floor covering and in the opposing longitudinal edge region on a wall-side spacer profile, which rests on a subfloor for the floor covering, wherein the wall-side spacer profile has at least first and second contact areas, which are arranged angularly offset to one another about the profile longitudinal axis, and the first and second contact areas have first and second opposing supports, respectively, for the floor profile, wherein the first and second supports have respective first and second support surfaces parallel to the associated first and second contact areas and respective first and second support lengths determined by the spacing of the first and second supports from the associated first and second contact areas, wherein the first support length is different from the second support length.

2. The device according to claim 1, wherein the wall-side spacer profile has a third contact area, wherein the second contact area is perpendicular to the first and third contact areas and has an associated third support having a third support surface parallel to the first contact area and a third support length determined by the spacing of the third support from the first contact area different from the first and second support lengths.

3. The device according to claim 2, wherein the wall-side spacer profile forms a substantially rectangular profile cross section and the third support extends beyond one wide side.

4. The device according to claim 3, wherein the third support is arranged offset in the direction of the adjoining long side of the rectangular profile section.

5. The device according to claim 1, wherein the wall-side spacer profile is implemented as a hollow profile.

6. The device according to claim 5, wherein the wall-side spacer profile is implemented as a circumferentially closed hollow profile.

7. The device according to claim 1, wherein the floor profile is fastened via adhesive beads on the floor covering and on the wall-side spacer profile.

* * * * *